US006021536A

United States Patent [19]

Wasinger et al.

[11] Patent Number: 6,021,536

[45] **Date of Patent: *Feb. 8, 2000**

[54] MECHANICAL DESIZING AND ABRADING DEVICE

[76] Inventors: Eric Wasinger, Applegate Apartments, 5100 Mira Mesa; Gary Gates, 8025 Jethro La., both of San Antonio, Tex. 78240

[ * ] Notice: This patent is subject to a terminal disclaimer.

[21] Appl. No.: 08/026,556

[22] Filed: Mar. 4, 1993

[51] Int. Cl.[7] ..... D06F 15/00

[52] U.S. Cl. ..... 8/159; 68/207; 68/17 R; 68/142; 68/158; 51/164.1

[58] Field of Search ..... 8/158, 159; 68/142, 68/158, 12.12, 12.19, 17 R, 207; 51/163.1, 164.1

[56] References Cited

U.S. PATENT DOCUMENTS

| | | | |
|---|---|---|---|
| 870,071 | 11/1907 | Wilson | 51/164.1 |
| 1,781,301 | 11/1930 | Randall | 51/164.1 |
| 1,946,440 | 2/1934 | Herrmann | 51/164.1 |
| 2,018,157 | 10/1935 | Urschell | 51/164.1 |
| 2,119,311 | 5/1938 | Biedermann | 51/164.1 |
| 2,592,054 | 4/1952 | Mertz et al. | 51/164.1 |
| 3,680,799 | 8/1972 | Hallerback | 51/164.1 |
| 4,148,252 | 4/1979 | Lewis | 51/164.1 |
| 4,434,629 | 3/1984 | Bianchi et al. | 68/207 X |
| 5,097,556 | 3/1992 | Engel et al. | 68/207 X |

FOREIGN PATENT DOCUMENTS

| | | | |
|---|---|---|---|
| 2915092 | 10/1979 | Germany | 68/142 |
| 847153 | 9/1960 | United Kingdom | 51/164.1 |

*Primary Examiner*—Frankie L. Stinson
*Attorney, Agent, or Firm*—John Lezdey

[57] ABSTRACT

A rotary barrel-type washer-extractor is provided with at least one slotted or apertured metal panel. The panel contains raised apertures or slots that protrude about 0.2 to 1 cm and have an opening about 0.3 to 1 cm in width. A method is also provided for desizing and abrading fabrics and garments utilizing at least one of the metal panels.

9 Claims, 1 Drawing Sheet

MECHANICAL DESIZING AND ABRADING DEVICE

FIELD OF THE INVENTION

The present invention relates to a means for mechanically desizing fabric and garments sore particularly, there is provided at least one slotted or apertured metallic abrasive panel for a rotary washer-extractor which desizes and softens fabrics and garments.

BACKGROUND OF THE INVENTION

Garment and fabric processing today includes dyeing and desizing. Sizing is important in the fabric weaving process. The size is usually removed in a finishing operation after the fabric is woven. In some fabrics e.g. denim, the size is left in to give desirable properties to the denim garment so as to improve the wear properties of the fabrics or garments. However, if the garments or fabrics are further processed, for example, treated with a crosslinking agent and/or decolorized or finished in garment form, it is necessary to first remove the sizing.

The removal of sizing is today performed in most textile plants by one or more of the following methods. The primary method of desizing is enzymatically, for example utilizing amylolytic enzymes. In garment finishing, this process is more costly. Mechanical action is another method of desizing. In this method, abrasive drum linings in extractors and/or pumice stones are utilized to improve the garment softness, give the garment special features, etc. Alkaline and acidic hydrolysis have also been employed but such techniques also cause chemical attack of the fabric so as to result in a loss of the abrasive strength of the fabric. Oxidative desizing is generally employed using large amounts of sodium hypochlorite in solution. The use of hypochlorite creates environmental problem and further can significantly degrade the fabric. Desizing is required where the fabrics or garments are to undergo further processing such as dyeing, printing, decolorization, treatment with a crosslinker, bleaching treatments and the like.

Stone washing is a technique used in the denim industry to decolorize and soften denims, especially denim garments. In practice, abrasive stones are placed with the garments or fabrics in a washer-extractor which is rotated. The stones pound the fabrics or garments and causes softening of the garment or fabric The stones further break off sizing and remove some of the dye. The stones have the disadvantage in that they are difficult to remove and also must be continuously replaced.

SUMMARY OF THE INVENTION

The present invention provides an abrasive metal panel for use in a rotary drum type washer-extractor to desize and soften fabrics and garments. The abrasive panel is provided with raised aperture or slots that protrude about 0.2 to 1 cm, preferably about 0.3 to 6 cm. The opening in the apertures or slots can be about 0.3 to 1 cm in width preferably about 0.3 to 0.5 cm. The openings should be such that button or snaps which are found on the garments do not get caught and cause damage to the garment.

The shape of the apertures is not critical. Advantageously, the apertures are round or elliptical in shape for ease in manufacture by a punching operation.

The panels can take the form of ribs within the washer-extractor or can comprise the entire interior of the washer-extractor depending on a particular use.

The washer-extractor with the abrasive panels of the invention is particularly adapted for use with an ozone treatment process for decolorizing denims.

It is therefore an object of the invention to provide a novel mechanical means for desizing and abrading fabric and garments in a single operation.

It is a further object of the invention to provide a means for desizing and abrading denims for further treatment with ozone.

It is another object of the invention to provide a method for simultaneously desizing and abrading garments and fabrics.

Other objects and advantages of the instant invention, as well as the invention itself, will become more apparent by reference to the disclosure and claims that follow, as well as the appended drawings.

DESCRIPTION OF THE PREFERRED EMBODIMENTS

Figure 1:
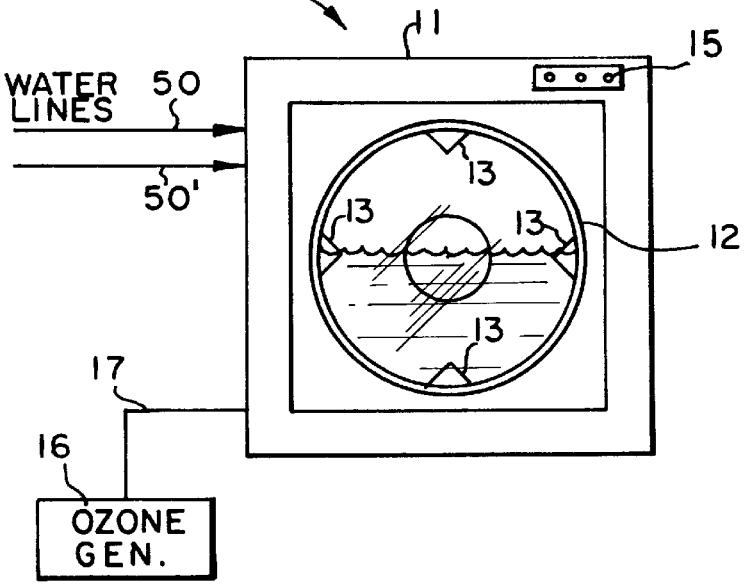
FIG. 1 is a front elevational view of a washer-extractor with one form of abrasive panels of the invention.

Although specific terms are used in the following description for the sake of clarity, these terms are intended to refer only to the particular structure of the invention selected for illustration in the drawings, and are not intended to define or limit the scope of the invention.

As seen in FIG. 1 a rotary type washer-extractor 10 having a housing 11, water lines 14,14,' controls 15 and a door 12 is provided with tumbling ribs 13 along its interior. The tumbling ribs 13 perform the operation of tumbling the fabric or garments within the washer-extractor 10 and also simultaneously desizing and abrading the fabric or garments on contact during the tumbling operation. The desizing and abrading of the fabrics or garments can take place when the garments or fabrics are wet or are immersed in an aqueous medium Optionally, the washer-extractor can be connected through a line 17 to a source of ozone 16 so as to treat the fabrics or garments with ozone during the mechanical desizing and abrading or afterwards. It is known that ozone alone can desize the fabrics or garments. However, the mechanical desizing expedites the desizing process and further abraded the fabric or garments.

Figure 2:
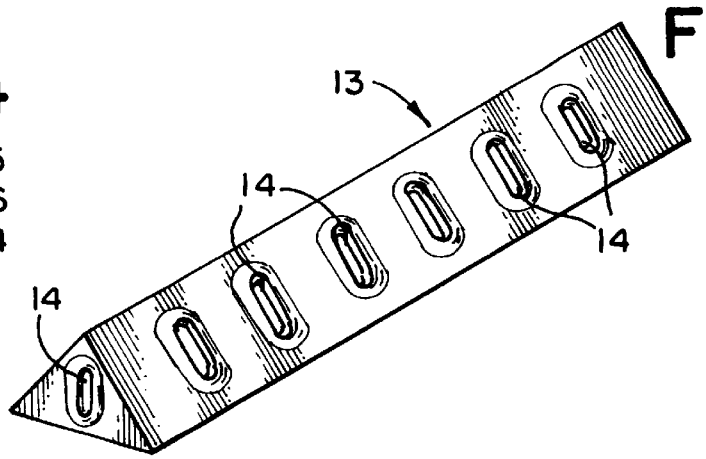
FIG. 2 is a perspective view of the panels of FIG. 1.

As seen in FIG. 2, the tumbling ribs 13 are formed from panels having a multiplicity of raised apertures 14. The rib 13 can be initially constructed in the rotary panel of the washer-extractor or tumbling ribs of existing washer-extractors can be modified by attaching panels with raised apertures to the existing tumbling ribs with suitable fasteners or welding. Alternatively, the panels can form the entire interior of the washer-extractor so as to provide a greater surface area to contact the raised apertures or slots and mechanically desize the fabric or garments.

Figure 3:
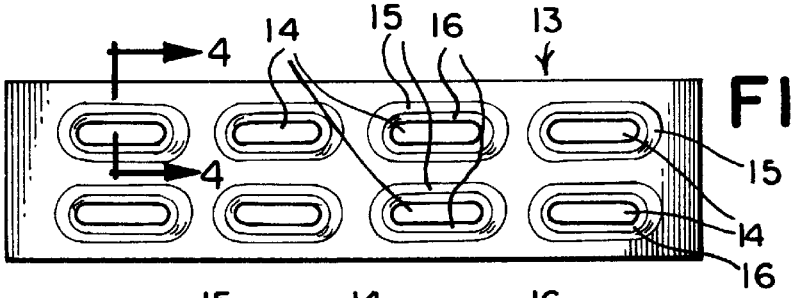
FIG. 3 is a perspective view of another form of a panel of the invention.

FIG. 3 illustrates an abrasive panel 20 having a plurality of raised apertures 21. The panel 20 is rectangular in shape and extends across the rotating interior of the washer-extractor. The panel 20 is provided with a series of apertures which are along the entire length of the panel 20.

Figure 4:
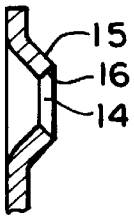
FIG. 4 is a cross-sectional view of the panel of FIG. 3.

FIG. 4 is a cross-sectional view of the apertures found on the metal panels of the invention. The height of the wall members 15,16 of the aperature is about 0.2 to 1 cm, preferably about 0.3 to 0.6 cm. The width of the opening is about 0.3 to 1 cm, preferably about 0.3 to 0.5 cm. The raised apertures desize and abrade by impact and rubbing as on a grate. The configuration of the apertures is not essential. However, the degree of the opening should be such as to prevent snaps, buttons or the like from being caught which may cause damage to the garment or fabric. The length of the panel is not essential. Its length is preferably the length of the rotary barrel. The amount of protrusion of the panel 20 into the washer-extractor is also not critical but should be sufficient to provide a striking surface and to cause the fabrics or garments to tumble during rotation for example, about 3 to 8 cm. The panels can be in one or more sections however, a single panel across the length of the rotating barrel is preferable.

Figure 5:
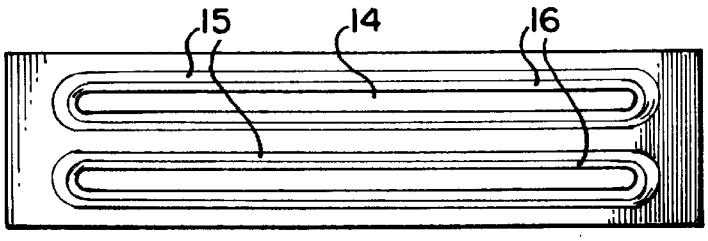
FIG. 5 is a perspective view of another form of panel of the invention.

FIG. 5, illustrates a panel 30 with slots 31 substantially along its length. However, the slots can be diagonal and still provide a desizing and abrading function.

The panels may be constructed of any metal which is inert to the environment and especially to ozone, for example, stainless steel.

The panels of the invention provide an advantage over stones for producing garments having a stone washed effect since the panels have a longer wear life and the additional step of removing the stones from the apparatus and the garments is not required. Optionally, the panels may be provided with a roughened or embossed surface to increase the degree of abrasion.

The invention may be embodied in other specific forms without departing from the spirit or essential characteristics thereof. The present embodiments are therefore to be considered illustrative and not restrictive, the scope being indicated by the appended claims rather than by the foregoing description, and all changes that come within the range of equivalency of the claims are therefore intended to be embraced therein.

What is claimed is:

1. In a rotary barrel type washer-extractor the improvement which comprises means for abrading and desizing a sized fabric or garment within the rotary barrel of said washer-extractor, said means comprising a multiplicity of metal panels that form ribs for tumbling said fabric or garment during rotation, said panels having raised aperatures or slots that protrude about 0.2 to 1 cm and have openings about 0.3 to 1 cm, whereby upon rotation of said barrel the garments or fabrics contact said panels and are desized and abraded.

2. In a rotary barrel type washer-extractor for treating a sized fabric or garment the improvement comprising means within said washer-extractor for abrading and desizing said sized fabric or garment during rotation, said means comprising ribs for tumbling the fabric or garment during operation, said ribs having raised apertures or slits that protrude about 0.2 to 1 cm and have openings about 0.3 to 1 cm, whereby upon rotation of said washer-extractor the garment or fabric is tumbled, desized and abraded.

3. The washer-extractor of claim 2 wherein the entire interior of said washer-extractor comprises said panels.

4. The washer-extractor of claim 2 wherein said panel contains a multiplicity of said apertures and said apertures are elliptical in shape.

5. The washer-extractor of claim 2 wherein said panel comprises a multiplicity of slots.

6. The washer-extractor of claim 2 which contains means for introducing ozone into said washer-extraction.

7. A method for desizing and abrading sized garments or fabrics in a washer-extractor which comprises the steps of rotating said sized garments or fabrics to come into contact with at least one metal panel having raised aperatures or slots that protrude about 0.2 to 1 cm and have openings about 0.3 to 1 cm so as to desize and abrade the garments or fabrics and introducing ozone into said washer-extractor.

8. The process-of claim 7 wherein said garments or fabrics are wet.

9. The process of claim 7 wherein said washer-extractor contains an aqueous medium.

* * * * *